US008740019B1

(12) United States Patent
Ciavarella et al.

(10) Patent No.: US 8,740,019 B1
(45) Date of Patent: Jun. 3, 2014

(54) FOAM DISPENSING SYSTEMS WITH MULTIPLE LIQUID SUPPLIES, AND RELATED REFILL UNITS

(71) Applicants: Nick E. Ciavarella, Seven Hills, OH (US); Michael J. Gallo, Twinsburg, OH (US)

(72) Inventors: Nick E. Ciavarella, Seven Hills, OH (US); Michael J. Gallo, Twinsburg, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/769,672

(22) Filed: Feb. 18, 2013

(51) Int. Cl.
*B65D 37/00* (2006.01)

(52) U.S. Cl.
USPC ..... 222/214; 222/63; 222/129.1; 222/138; 222/145.5; 222/145.6; 222/190; 417/477.1

(58) Field of Classification Search
USPC ..... 222/52, 63, 129, 129.1–129.4, 135, 222/138, 145.5–145.6, 325, 190, 183, 333, 222/213–215; 417/474–476, 477.1
See application file for complete search history.

(56) References Cited

U.S. PATENT DOCUMENTS

| | | | | | |
|---|---|---|---|---|---|
| 5,353,963 | A * | 10/1994 | Gorski et al. | ..... | 222/129.1 |
| 5,875,930 | A * | 3/1999 | Nakajima et al. | ..... | 222/129.1 |
| 5,938,414 | A * | 8/1999 | Kayahara et al. | ..... | 417/476 |
| 6,003,733 | A * | 12/1999 | Wheeler | ..... | 222/146.5 |
| 6,016,935 | A * | 1/2000 | Huegerich et al. | ..... | 222/146.1 |
| 6,142,340 | A * | 11/2000 | Watanabe et al. | ..... | 222/66 |
| 7,651,610 | B2 * | 1/2010 | Tsai | ..... | 210/167.26 |
| 8,550,310 | B2 * | 10/2013 | Alstad et al. | ..... | 222/214 |
| 2006/0249536 | A1 * | 11/2006 | Hartman et al. | ..... | 222/129.3 |
| 2013/0175296 | A1 * | 7/2013 | Gray et al. | ..... | 222/135 |

* cited by examiner

*Primary Examiner* — Frederick C Nicolas
(74) *Attorney, Agent, or Firm* — Calfee, Halter & Griswold LLP

(57) ABSTRACT

An exemplary foam dispenser includes a housing, a plate located in the housing, a first dispensing wheel located proximate the plate. The first dispensing wheel has a plurality of pinch members and is rotatable about an axis. The exemplary dispenser includes a second dispensing wheel located proximate the plate. The second dispensing wheel having a plurality of pinch members and rotatable about the same axis as the first dispensing wheel. Rotation of the first dispensing wheel is configured to pinch a first flexible tube against the plate and to move a first liquid through the first tube; and rotation of the second dispensing wheel is configured to pinch a second flexible tube against the plate and to move a second liquid through the first tube. The exemplary dispenser includes a motor for rotating the first and second dispensing wheels and a motor controller for starting and stopping the motor.

20 Claims, 4 Drawing Sheets

FOAM DISPENSING SYSTEMS WITH MULTIPLE LIQUID SUPPLIES, AND RELATED REFILL UNITS

TECHNICAL FIELD

The present invention relates generally to foam dispensing systems having multiple liquid supplies, and refill units for such dispensing systems.

BACKGROUND OF THE INVENTION

Liquid dispensing systems, such as liquid soap and sanitizer dispensers, provide a user with a predetermined amount of liquid upon actuation of the dispenser. In addition, it is sometimes desirable to dispense the liquid in the form of a foam. Foam is generally made by injecting air into the liquid to create a foamy mixture of liquid and air bubbles.

SUMMARY

Exemplary embodiments of foam dispensers and refill units are disclosed herein. An exemplary foam dispenser includes a housing, a plate located in the housing, a first dispensing wheel located proximate the plate. The first dispensing wheel has a plurality of pinch members and is rotatable about an axis. The exemplary dispenser includes a second dispensing wheel located proximate the plate. The second dispensing wheel having a plurality of pinch members and rotatable about the same axis as the first dispensing wheel. Rotation of the first dispensing wheel is configured to pinch a first flexible tube against the plate and to move a first liquid through the first tube; and rotation of the second dispensing wheel is configured to pinch a second flexible tube against the plate and to move a second liquid through the first tube. The exemplary dispenser includes a motor for rotating the first and second dispensing wheels and a motor controller for starting and stopping the motor.

An exemplary refill unit for a foam dispensing system includes a first container holding a first liquid and a first outlet tube extending away from the first container. In addition, the refill unit includes a second container holding a second liquid and a second outlet tube extending away from the second container. The first liquid and the second liquid chemically react when combined with one another. The refill unit includes a space between the first liquid tube and the second liquid tube for receiving a plate therebetween. A mixing tube is also included and each of the first outlet tube and the second outlet tube are fluidically connected to the mixing tube, such that a mixing chamber is formed within the mixing tube at a point where the first liquid mixes with the second liquid. A sealing member to seal the first outlet tube and second outlet tube when the refill unit is not installed in a dispenser is also included. The first outlet tube and the second outlet tube have a flexible portion which is disposed within a pinching region of the foam dispensing system, such that at least one pinching element of the dispensing system successively engages and disengages the flexible portion of the first outlet tube and the second outlet tube, to thereby cause the first liquid and the second liquid to enter the mixing chamber and form a mixture that expands to become a foam.

An exemplary foam dispensing system includes a first container holding a first liquid and a first outlet tube extending away from the first container. It also includes a second container holding a second liquid and a second outlet tube extending away from the second container. A mixing tube is also provided wherein each of the first outlet tube and the second outlet tube are fluidically connected to the mixing tube, such that a mixing chamber is formed within the mixing tube at a point where the first liquid mixes with the second liquid. A first dispensing wheel is mounted on a shaft defining an axis of rotation for the first dispensing wheel. The first dispensing wheel includes at least one pinching element disposed on an interior side of the first dispensing wheel which is adjacent to at least one of the first outlet tube, the second outlet tube, and the mixing tube. A second dispensing wheel mounted is mounted on the shaft. The second dispensing wheel includes at least one pinching element disposed on an interior side of the second dispensing wheel which is adjacent to at least one of the first outlet tube, the second outlet tube, and the mixing tube. An actuator is provided for rotating the first and second dispensing wheels around the axis of rotation such that, as the first and second dispensing wheel rotate, the pinching elements successively engages and disengages at least one of the first outlet tube, the second outlet tube, and the mixing tube, to thereby cause the first liquid and the second liquid to enter the mixing chamber and form a mixture that expands to become a foam.

The systems and refill units for dispensing a mixture of multiple liquid supplies disclosed herein provide a simple and economical pumping system.

BRIEF DESCRIPTION OF THE DRAWINGS

These and other features and advantages of the present invention will become better understood with regard to the following description and accompanying drawings in which.

DETAILED DESCRIPTION

Figure 1:
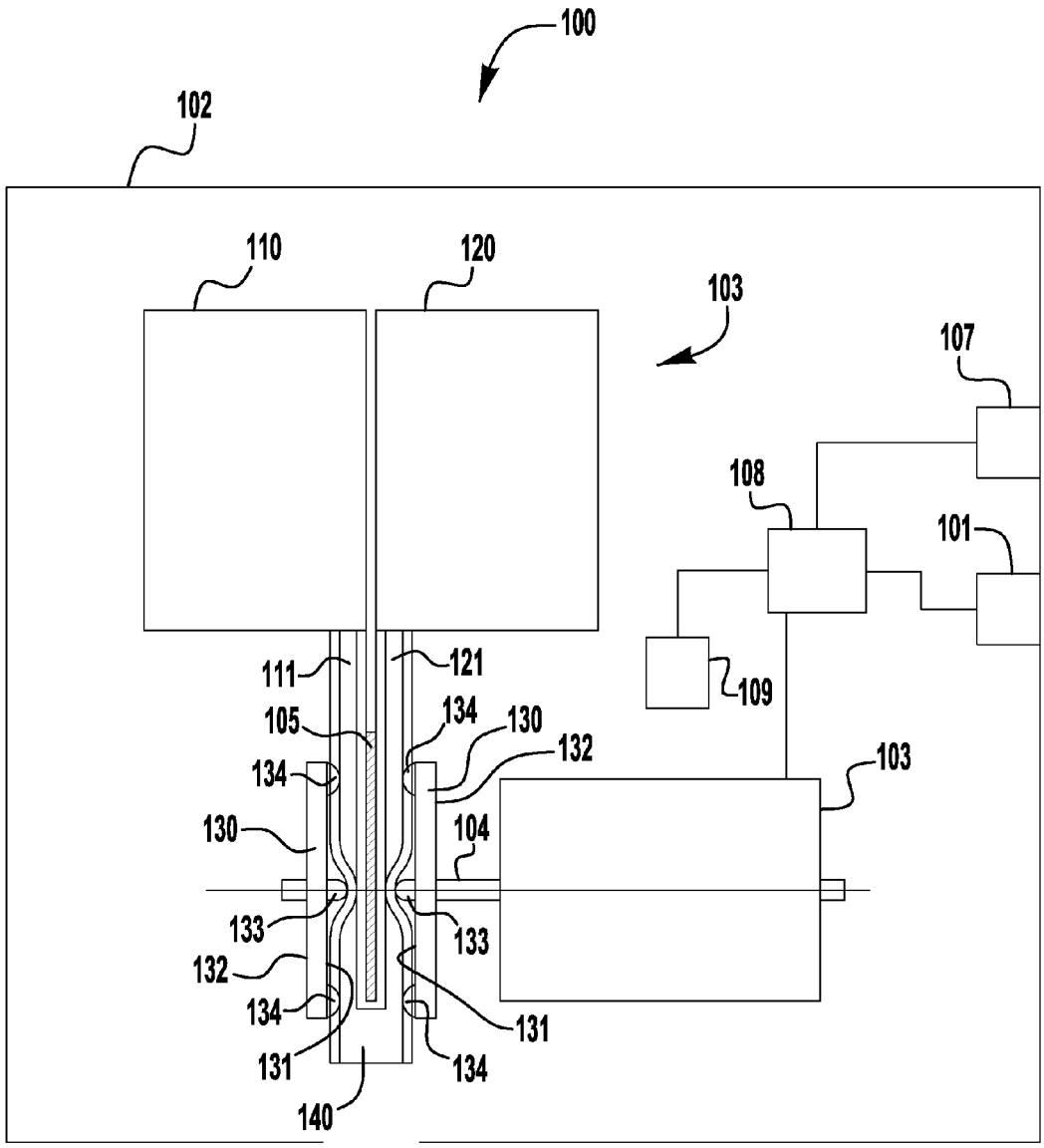
FIG. 1 is a partial cross-sectional front view of an exemplary dispensing system 100.
Figure 2:
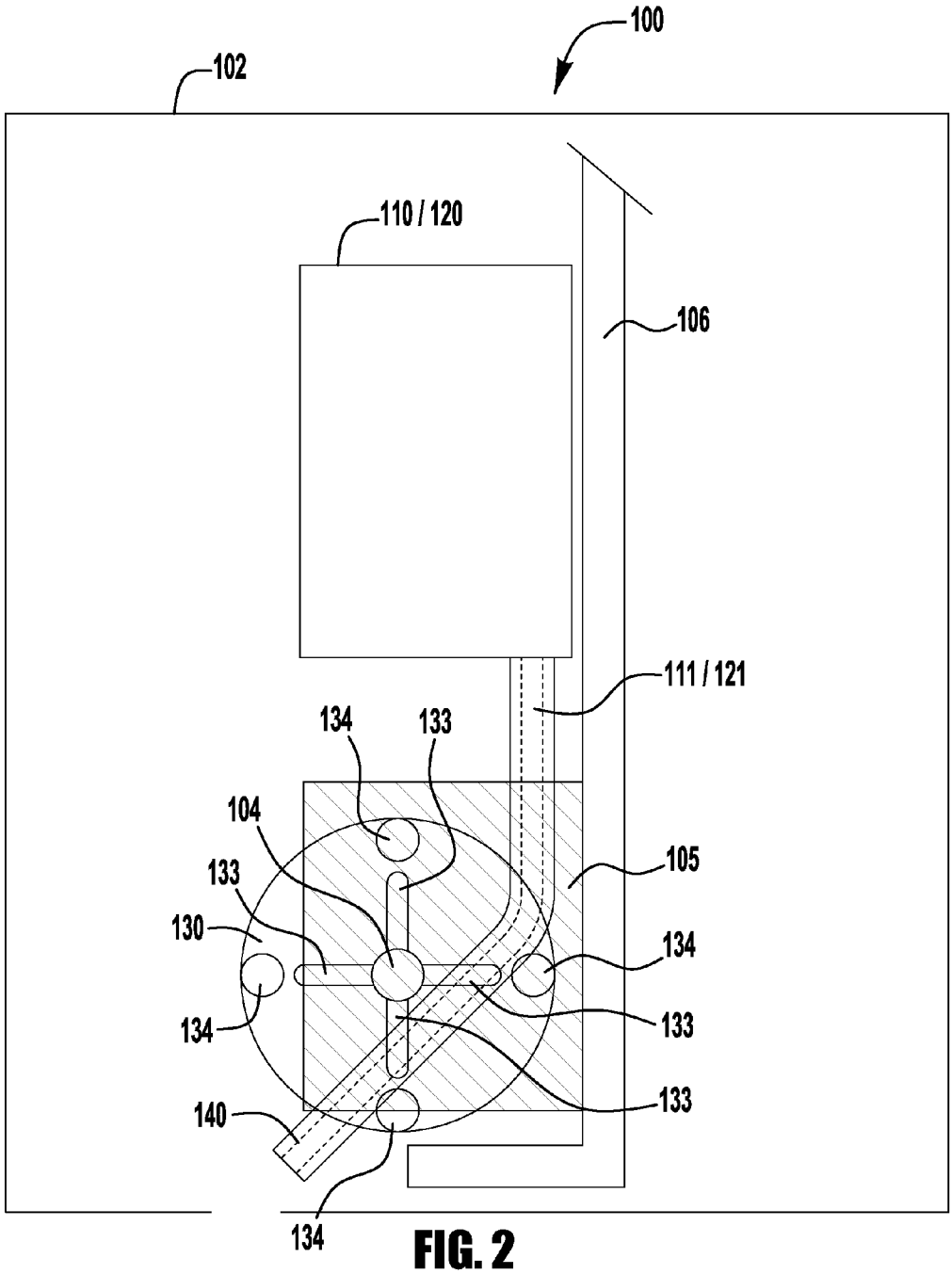
FIG. 2 is a partial cross-sectional side view of the exemplary dispensing system 100.

FIGS. 1 and 2 are partial cross-sectional views of an exemplary dispensing system 100 for mixing and dispensing multiple supplies of liquids. The exemplary dispensing system 100 disclosed and described herein is an electrically-operated, touch-free dispenser. Thus, the dispensing system 100 includes an electrical power supply 101. The electrical power supply 101 may be provided by one or more batteries, or a transformer and/or rectifier connected to a separate power source, or combinations thereof. However, other types of dispensers may be used, such as for example manually-operated dispensers. Manual dispensers may be actuated without the need for an electrical power supply by manipulating a manual actuator such as a push actuator, a lever actuator, a pull actuator, a turn actuator or the like.

The dispensing system 100 includes a housing 102 which encloses a first liquid container 110 with a first outlet tube 111, a second liquid container 120 with a second outlet tube 121, a motor 103, a rotating shaft 104, two dispensing wheels 130 mounted on the shaft 104, a mixing outlet tube 140, and a rigid plate member 105. First and second container 110, 120 and other parts are shown schematically and are not to scale. Some of these components may together form a unitary refill unit 103 which is separable from the other components inside the housing 102 to permit an easy, fast, and hygienic refilling process for the dispensing system 100. In that event, the dispensing system 100 may include a holder 106 for receiving and securing the refill unit 103 within the housing 102. The interaction (not shown) between the refill unit 103 and the holder 106 may take any convenient form, such as for example a rotatable lock ring, interlocking tabs and slots, and the like. Dispenser system 100 includes a sensor 109 for determining a position of the dispensing wheel.

In a first example, a refill unit 103 may be formed by the combination of the first container 110 and the second container 120, together with their respective outlet tubes 111 and 121, in one unit. In that event, when one or both of the containers 110 and 120 becomes empty of liquid, the refill unit 103 may be removed from the housing 102 and replaced with another refill unit 103 having filled containers 110 and 120. In this first example, one or more separable fluidic connections are provided between the outlet tubes 111 and 121 and the mixing tube 140, which remains inside the housing 102 as the refill units 103 are exchanged. Thus, the replacement refill unit 103 may conveniently include one or more plugging elements attached to the free end(s) of the outlet tubes 111 and 121 in order to prevent liquid from spilling out of the containers prior to installation. The user may then simply remove the plugging element(s) when the replacement refill unit 103 is inserted into the dispensing system 100. The plugging element(s) may be formed so that, if the user forgets to remove the plugging element(s) before inserting the replacement refill unit 103 into the housing 102, the housing 102 will not properly close. In that way the user is alerted that the plugging element(s) need to be removed in order for the recharged dispensing system 100 to operate.

In a second example, a refill unit 103 may be formed by the combination of the first liquid container 110 with the first outlet tube 111, the second liquid container 120 with the second outlet tube 121, and the mixing outlet tube 140, all together in one unit. This embodiment has the advantage that all of the components of the system 100 which come into physical contact with liquid are part of the refill unit 103. Thus, when an empty refill unit 103 is replaced, the user does not need to undo or make any liquid-tight connections. One or both of the dispensing wheels 130 may be dismounted from the shaft 104 in order to facilitate the respective removal and installation of these refill units 103.

Two representative examples of a refill unit 103 have been provided herein. Of course, other combinations of components into a refill unit 103 are also possible. Either of the two examples provided here, or yet other refill units 103, may include a clipping element (not shown) in order to help prevent leakage of liquids from the refill unit 103 when it is not installed within a dispensing system. The clipping element has a closed position, in which it prevents liquid from escaping the refill unit 103. The clipping element also has an open position, in which it allows liquid to escape from the refill unit 103. The clipping element may be user-operated to switch between the closed and open positions as the refill unit 103 is inserted into or removed from the housing 102 of the system 100. The housing 102 of the system 100 may be configured to prevent a full installation of the refill unit 103 without removal of the clipping element by the user. Or, the housing 102 may include a mating element (not shown) which interacts with the clipping element on the refill unit 103 to automatically open the clipping element upon proper installation, or to automatically close upon removal.

The exemplary touch-free electrically operated dispensing system 100 includes an object sensor 107 exposed to the exterior of the housing 102, and electrically connected to a motor controller 108. The motor controller 108 includes associated circuitry for using the sensor 107 to detect an object in close proximity to the sensor 107 (such as a user's moving hand). In response to detecting an object, the motor controller 108 operates the motor 103 to initiate a liquid dispensing action. The motor 103 therefore rotates the shaft 104 and the two dispensing wheels 130 mounted on the shaft 104. Although not shown, one or more gears may be disposed between the motor 103 and the shaft 104 to effectuate a proper rotation of the shaft 104. In any event, rotation of the dispensing wheels 130 on the shaft 104 dispenses a dose of a mixture of liquids from the containers 110 and 120, as described in more detail below. For the sake of simplicity in the figures, the object sensor 107 of the dispensing system 100 is shown as being disposed in proximity to the containers 110 and 120, relatively far above the mixing outlet tube 140. In other embodiments (not shown), the object sensor 107 may conveniently be disposed in a close proximity to the mixing outlet tube 140.

A similar actuation may occur in manually-operated dispenser embodiments (not shown). In a manually-operated dispenser, the user operates a manual actuator disposed on the exterior of the housing 102, which in turn is connected to a gearing or other transmission within the housing 102 to rotate the shaft 104 and initiate a liquid dispensing action.

The first liquid is different in composition from the second liquid. In one such embodiment, the first liquid includes a weak acid and the second liquid includes a weak base. When the two liquids combine in the mixing tube 140, a gas is formed, and the mixture expands and forms a foam. The foam may be a soap, a sanitizer or a lotion. In addition, one or both of the liquids may contain a wax. The gas created by the combination of the two liquids mixes with, and is trapped in, the wax to form a thick foam. Again, the thick foam may be a soap, sanitizer or lotion.

In other embodiments (not shown), additional containers for holding yet additional liquids or other additives may be included. Accordingly, some dispensers and refill units 103 mix and dispense mixtures of three or more liquids. The structure and operations disclosed herein with respect to the two liquid component system 100 may readily be applied to such larger systems. For example, a third liquid container with a third outlet tube may be added to the illustrated dispensing system 100, such that the third liquid outlet tube is disposed next to one of the other two liquid outlet tubes 111 and 121 already present in the system 100.

As discussed above, the dispensing system 100 includes a first outlet tube 111 in fluid communication with the first container 110 and a second outlet tube 121 in fluid communication with the second container 120. Although not shown, either one or both of the container outlet tubes 111 and 121 may include a one-way liquid valve disposed between its respective container and the mixing outlet tube 140. Such a one-way liquid valve may be any type of one-way valve, such as for example, a mushroom valve, a flapper valve, a plug valve, an umbrella valve, a poppet valve, or a duck-bill valve. If utilized, the one-way valve helps to ensure liquid flows only in the direction moving from the containers 110 and 120 to the mixing outlet tube 140, and not in the opposite direction.

Figure 3:
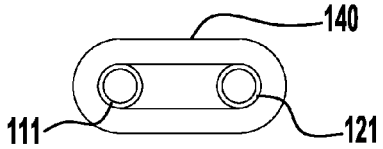
FIG. 3 is a bottom view of the liquid delivery tubes within the exemplary dispensing system 100.

Each one of the container outlet tubes 111 and 121 leads to a common mixing outlet tube 140. In the particular embodiment of the illustrated dispensing system 100, each container outlet tube 111 and 121 is circular in cross-section, and enters into the elongated mixing tube 140 as shown in FIG. 3. In other embodiments, the various tubes may comprise a single structure, or any suitable combination of separate components. Thus, for example, the two outlet tubes 111 and 121 may together form one integral "V"-shaped structure, which is then fluidically connected to the mixing outlet tube 140 to form an overall "Y"-shaped structure. As described further below, a portion of one or more of the liquid delivery tubes 111, 121 and 140 is disposed between the two dispensing wheels 130. Those portions are at least partially comprised of a flexible material which is successively pinched and released by the dispensing wheels 130 in order to pump liquid through the system. Suitable flexible tube materials include, for example, latex rubber, polyisoprene, silicone, EPDM rubber, nitrile rubber and the like. Other portions of the tubes 111, 121 and 140 which are disposed above or below the dispensing wheels 130 may comprise a flexible material like the portions between the wheels 130, or alternatively a more rigid material if desired.

FIGS. 4 to 7 illustrate at least a portion of a dispensing actuation of the dispenser system 100. For purposes of clarity, dispensing wheel 130 is illustrated with outlines so the outlet tubes 111, 121 are visible. During that actuation, an interaction between the rotating dispensing wheels 130 and one or more of the flexible tubes 111, 121 and 140 disposed between the dispensing wheels 130 dispenses a supply of foam 402 from the mixing outlet tube 140. FIG. 8 shows a perspective view of a dispensing wheel 130. Thus, each dispensing wheel 130 has an interior side 131 which faces the liquid delivery tubes 111, 121, and an exterior side 132 which faces away from the liquid delivery tubes 111, 121. The interior side 131 of the wheel 130 includes pinching elements 133 and bumper elements 134. Two wheels 130 are mounted on the rotating shaft 104 so that, as the respective interior sides 131 face each other, the pinching elements 133 of one wheel 130 are aligned with the pinching elements 133 of the other wheel 130. Similarly, the bumper elements 134 of one wheel 130 are aligned with the bumper elements 134 of the other wheel 130. While the wheels 130 as shown in the figures are circular-shaped, other embodiments may use wheels of other shapes such as a triangle, a square, a hexagon, an oval or the like.

In the illustrated dispensing system 100, each dispensing wheel 130 includes four pinching elements 133*a*, 133*b*, 133*c* and 133*d* equally spaced around the wheel 130. Also, each dispensing wheel 130 includes four bumper elements 134*a*, 134*b*, 134*c* and 134*d* equally spaced around the periphery of the wheel 130 at the same radial positions as the four pinching elements 133 (see FIG. 8). One of ordinary skill in the art, upon reading the present disclosure, will understand that many different configurations of pinching elements 133 and bumper elements 134 may be used. Thus, only a single pinching element 133 may be used, up to any maximum number permitted by the size of the wheel 130 and the size of the pinching elements 133 on the wheel. And, any number of bumper elements 134 may be used, including zero bumper elements. In additional embodiments, the positioning of the pinching elements and the bumper elements may be unevenly spaced around the periphery of the wheel 130. And, the respective pinching elements and bumper elements may be disposed along different radii of the wheel 130. In some cases, it may even be advantageous to offset the pinching elements 133 of one wheel 130 from the pinching elements 133 of the other wheel 130. Further, one dispensing wheel 130 may have more or less pinching elements 133 then the other dispensing wheel 130

In the illustrated dispensing wheel 130 embodiment, the pinching elements 133 and the bumper elements 134 are formed as protuberances on the interior side 131 of the dispensing wheel 130. One of ordinary skill in the art, upon reading the present disclosure, will understand that many different forms of pinching elements 133 and bumper elements 134 may be used. Thus, as one example (not shown), each pinching element may comprise a roller rotatably mounted on a shaft which extends in the radial direction of the wheel 130. Such an embodiment would help to reduce the friction generated between the pinching elements 123 and the liquid delivery tube(s) 111, 121 caught between the pinching elements 123, described further below. As another example (not shown), the pinching elements 123 may comprise spring-loaded projections on the interior side 131 of the wheel 130.

Figure 4:
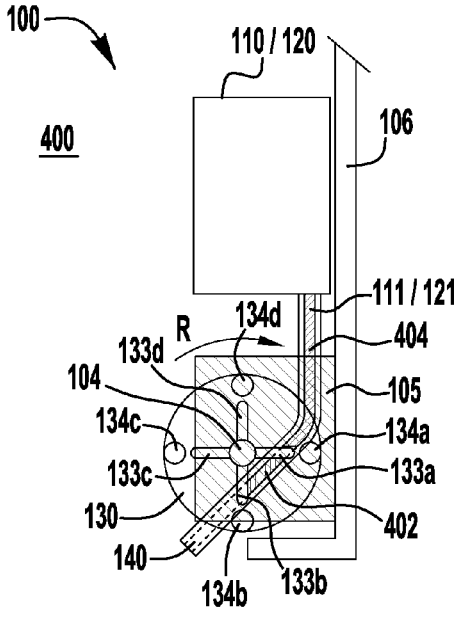
FIG. 4 is a side view of the exemplary dispensing system 100, in an initial resting state 400.
Figure 5:
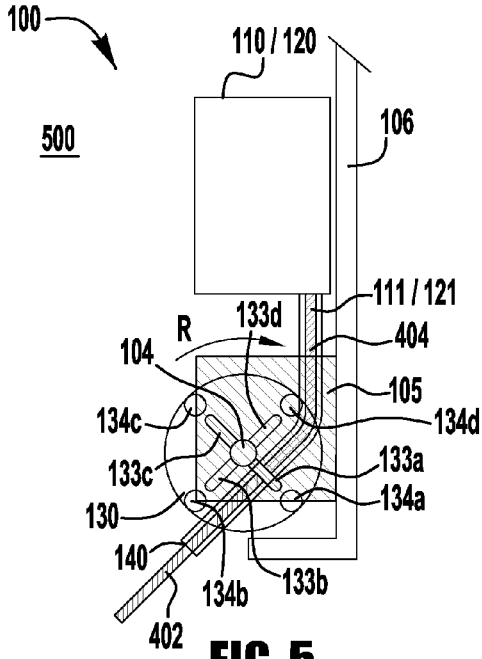
FIG. 5 is a side view of the exemplary dispensing system 100, in a first intermediate state 500.

FIG. 4 shows the exemplary dispensing system 100 in an initial resting state 400. In that initial resting state 400, the opposed pinching elements 133*a* of the dispensing wheels 130 squeeze the flexible container outlet tubes 111 and 121 between the pinching elements 133*a* at a pinch point. That prevents liquid(s) from flowing past the pinch point, upwards or downwards within the tubes 111 and 121. A plate 105 may optionally be disposed between the two container outlet tubes 111 and 121 in order to increase the efficacy of the pinching elements 133*a*. In other embodiments, only the flexible tubes 111 and 121 may be disposed between the wheels 130, without any further supports or other elements.

In the initial resting state 400, the pinching elements 133*a* define a primed downstream portion 402 and an upstream portion 404 within each flexible outlet tube 111 and 121. The opposed pinching elements 133*b* located downstream of the pinching elements 133*a* similarly form a pinch point of the outlet tubes 111 and 121. Thus a primed charge 402 of each liquid is separately captured within the respective outlet tubes 111 and 121 between the sets of pinching elements 133*a* and 133*b*.

During operation, upon detecting an object through sensor 107, the motor controller 108 operates the motor 103 to rotate the shaft 104 in the direction R. The dispensing wheels 130 are correspondingly rotated from the initial resting state 400 to the first intermediate state 500 illustrated in FIG. 5. The rotation frees the flexible outlet tubes 111 and 121 from the two downstream pinching elements 133*b*. Once freed, the flexible outlet tubes 111 and 121 act as a self-biasing member and expand out to an un-pinched diameter, to permit the primed charge 402 of liquid to flow past the now-released pinch point. At the same time, the continued pinching of the flexible outlet tubes 111 and 121 between the two upstream pinching elements 133*a* forces the primed liquid charge 402 within the outlet tubes 111 and 121 to move downwardly within the tubes. And, the next pair of pinching elements 133*d* rotate closer to the flexible outlet tubes 111 and 121.

The two liquids forming the primed charge 402 collide together and begin mixing in the flexible mixing tube 140 downstream of the pinching elements 133*a*. A mixing chamber is formed in the flexible mixing tube 140 at the point where the two container outlet tubes 111 and 121 empty into the common flexible mixing tube 140. In some embodiments, the flexible mixing tube 140 is made to narrow in the region of the mixing chamber to cause the liquids to mix more forcefully, such as with a conical shape or other tapered shape. In some embodiments, the interior surface of the flexible mixing tube 140 may alternatively or additionally be provided with baffles in the region of the mixing chamber to increase the mixing of the liquids.

The mixing outlet tube 140 leads down to exit the housing 102 of the dispensing system 100. Typically, the chemical reaction between the mixed liquids continues to form a foamy product as the mixture continues its journey down the tube 140. The distal end of the mixing outlet tube 140 outside of the housing 102 may simply be an open end of the tube 140 from which the mixed foam is dispensed for use by the person who actuated the dispensing system 100. In other embodiments, an outlet nozzle (not shown) may be secured to the distal end of the mixing outlet tube 140. In some embodiments, the outlet nozzle has a conical shape or is otherwise narrowed to promote additional mixing of the two or more liquids and enhance the quality of the foam output. In some embodiments, the outlet nozzle includes one or more baffles that cause turbulence to the liquids passing through and vigorously mixes the liquids together to increase the reaction occurring between the liquids. In addition, the outlet nozzle may include a one-way outlet check valve, such as the one-way valves identified above.

Figure 6:
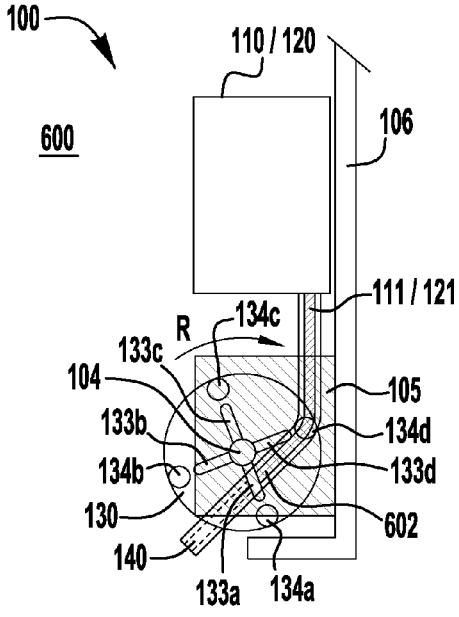
FIG. 6 is a side view of the exemplary dispensing system 100, in a second intermediate state 600.

The motor controller 108 operates the motor 103 to continue the rotation of the shaft 104 in direction R from the first intermediate state 500 to the second intermediate state 600 of FIG. 6. The continued pinching of the flexible outlet tubes 111 and 121 between the pinching elements 133*a* prevents liquid(s) within those tubes from flowing past the pinch point, upwards or downwards. Thus, as the dispensing wheels 130 rotate in direction R, the pinching elements 133*a* define a primed upstream portion 602 of the outlet tubes 111 and 121. The next opposed pinching elements 133*d* similarly engage with and form a pinch point of the flexible outlet tubes 111 and 121. Thus a primed charge 602 of each liquid begins to be captured within the respective outlet tubes 111 and 121 between the sets of pinching elements 133*a* and 133*d*.

Figure 7:
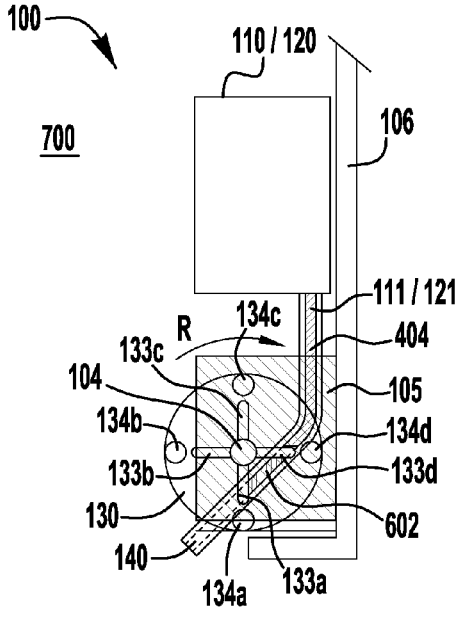
FIG. 7 is a side view of the exemplary dispensing system 100, in a third intermediate state 700.
Figure 8:
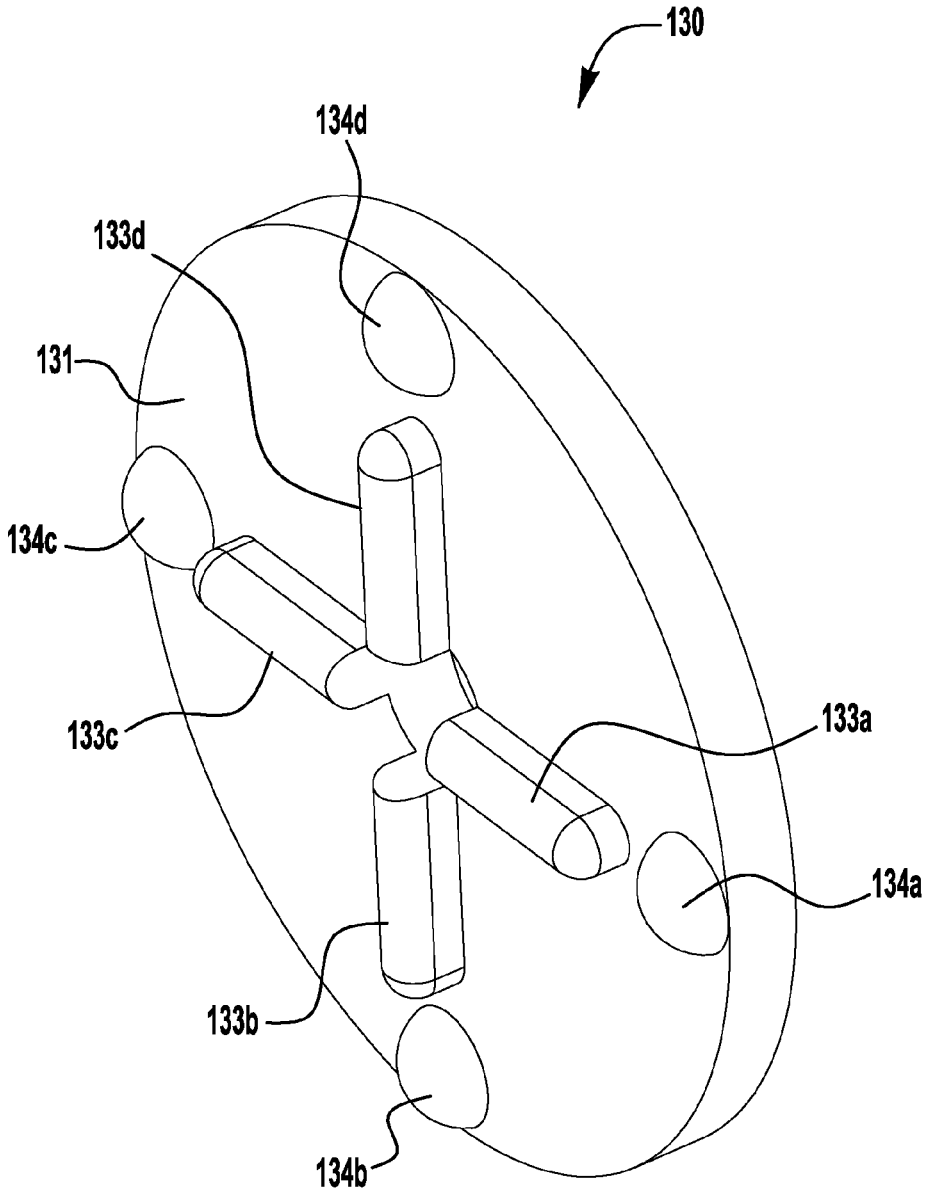
FIG. 8 is a perspective view of a dispensing wheel 130.

The rotation in direction R of the dispensing wheels 130 continues from the second intermediate state 600 to the third intermediate state 700 of FIG. 7. The continued pinching of the flexible outlet tubes 111 and 121 between the downstream pinching elements 133*a* prevents liquid(s) within the tubes 111 and 121 from flowing past the pinch point, upwards or downwards. The upstream pinching portions 133*d* similarly fully engage the flexible outlet tubes 111 and 121 to prevent liquid(s) within the tubes 111 and 121 from flowing past the upstream pinch point. Thus, in the third intermediate state 700, a primed charge 602 of each liquid is fully and separately captured within the respective outlet tubes 111 and 121 between the sets of pinching elements 133*a* and 133*d*.

As will be appreciated, the third intermediate state 700 of FIG. 7 is identical to the initial resting state 400 of FIG. 4, after the wheels 130 have undergone a 90° rotation. During the rotation R of the wheels 130 from the initial resting state 400 to the third intermediate state 700, the flexible container outlet tubes 111 and 121 have been released by pinch member 133*b* and pinched pinch member 133*d* one time. In some embodiments, the motor controller 108 may then stop the rotation in direction R of the dispensing wheels 130 in the state 700, which in those embodiments becomes a final resting state of the dispensing system 100. The system 100 then remains in that resting state until the controller 108 again detects an object through the object sensor 107 outside of the dispensing system 100, when the dispensing cycle begins anew starting at the initial resting state 400 shown in FIG. 4.

In other embodiments, however, a single dispensing action will result in more than one pinch being applied to the flexible liquid delivery tubes between the dispensing wheels 130. In these embodiments, the motor controller 108 will continue the rotation in direction R of the dispensing wheels 130 upon reaching the third intermediate state 700. The rotation cycle then continues, as described above starting at the position 400. The motor controller 108 is programmed to rotate the dispensing wheels 130 for a sufficient time to dispense a desired amount of foamed liquid. For example, the various parts of the system 100 may be dimensioned so that the primed charge 402 is only about 0.45 cubic centimeters. Eventually the rotation stops, preferably with the wheels 130 in a final position 700 of FIG. 7. Thus, dosing sizes of the dispensing system 100 may be altered by programming different rotation times into the motor controller 108. Accordingly, the dispensing system 100 is a variable dosing pump.

It may be advantageous in some embodiments to include a tracking means which permits the motor controller 108 to monitor the position of the dispensing wheels 130 within their rotation. For example, the motor controller 108 may then ensure that the wheels 130 are stopped in the position 700 of FIG. 7. One of ordinary skill in the art will know of many such tracking means, as the state of the art exists at the present time or in the future. In one example, the tracking means may comprise a motor encoder (not shown) which monitors the operation of the motor 103, as is well known in the art. In another example, the tracking means may comprise a nub or other element disposed on the wheel 130 which contacts a switch (not shown) as the wheel 130 rotates, as is also well known in the art. In yet another example, the tracking means may comprise a magnetic sensor (not shown) which monitors one or more permanent magnets disposed on the exterior side 132 or on the periphery of a wheel 130 as it rotates, as is also well known in the art. Optionally, a sensor (not shown) may be used to determine the position of the dispensing wheel 130. The sensor may be any type of sensor that provides an output indicative of a position of the dispensing wheel 130.

In the particular system 100 illustrated and described above, only the two container outlet tubes 111 and 121 are pinched by the rotation of the dispensing wheels 130. In other embodiments (not shown), a flexible portion of the mixing outlet tube 140 may be disposed in between the wheels 130 to be pinched during the rotation.

Each one of the pinched tubes forms a variable volume passage which is compressed and stretched under the pinching of the dispensing wheels 130. That is, the pinching elements 133 of the wheels 130 first engage and then release the pinched tubes as the wheels 130 rotate in direction R. When released, each pinched tube acts as a self-biasing member and expands out to an un-pinched diameter, to permit liquid to flow past the now-released pinch point. In some embodiments, the compressing and stretching prevents waxy residue and other liquids from adhering to and building up within the pinched tubes.

In addition, bumper elements 134 may optionally be disposed on the interior side 131 of one dispensing wheel 130 or both dispensing wheels 130 to supplement the tube cleaning action of the pinching elements 133. As the dispensing wheels 130 rotate in direction R, the bumper elements 134 contact the sides of the flexible tubes 111, 121 and the mixing tube 140 disposed between the wheels 130 to knock out wax and other residue, and also to agitate the mixing action within the mixing tube 140. Minimizing such residues helps prevent blockage of the tubes.

To insert refill unit 103 into dispenser housing 102, a user moves a lever (not shown) to the load position that opens the area between dispensing wheels 130 and secures the refill unit to holder 106. The user pulls the end of the mixing outlet tube 140 over the plate 105 so that outlet tube 111 is on one side and outlet tube 121 is on the other. The user moves the lever back to the run position and the dispensing wheels 130 move back in and pinch the outlet tubes 111, 121. In some embodiments, the user removes a clip (not shown) that pinches outlet tubes 111, 121 shut so liquid does not leak during shipment.

In one embodiment, one or more projections (not shown) secured to the lever and when the lever is moved to the run position, the one or more projections expand the clip to allow fluid to flow through the lines. When the lever is moved to the load position, the one or more projections move and allow the clip to contract to seal the outlet tubes 111, 121. In another embodiment, a plug (not shown) is located in the mixing outlet tube 140 and extends into the first and second outlet tubes 111, 121 and is pulled out by a user after the refill unit 130 is installed. The plug may be retained to plug the end when the refill unit 103 is removed.

By minimizing such residues, this cleaning action also can help to prevent dripping of residual liquids which remain within the system 100 after a dispensing action is complete. Nonetheless, the dispensing system 100 may additionally include a drip catcher (not shown) in the outlet mixing tube 140 downstream of the mixing chamber. The drip catcher may be, for example, an annular projection that projects upward within the channel of the outlet mixing tube 140. Such a drip catcher catches any residual liquid or foam that travels down the walls of the flexible mixing outlet tube 140 after the dispensing cycle has been completed and the actuating object has been removed from the vicinity of the object sensor 107.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A foam dispenser comprising:

a housing;

a plate located in the housing;

a first dispensing wheel located proximate the plate;

the first dispensing wheel having a plurality of pinch members;

the first dispensing wheel rotatable about an axis;

a second dispensing wheel located proximate the plate;

the second dispensing wheel having a plurality of pinch members;

the second dispensing wheel rotatable about the same axis as the first dispensing wheel;

wherein rotation of the first dispensing wheel is configured to pinch a first flexible tube against the plate and to move a first liquid through the first tube; and wherein rotation of the second dispensing wheel is configured to pinch a second flexible tube against the plate and to move a second liquid through the first tube;

a motor for rotating the first and second dispensing wheels; and a motor controller for starting and stopping the motor.

2. The foam dispenser of claim 1 further comprising a plurality of nubs secured to at least one of the first and second dispensing wheels, wherein the nubs are configured to strike a mixing tube of a refill unit installed in the dispenser as the nubs rotate past mixing chamber.

3. The foam dispenser of claim 1 wherein the plurality of pinch members on the first dispensing wheel are aligned with the plurality of pinch members on the second dispensing wheel.

4. The foam dispenser of claim 1 wherein the pinch members are rollers.

5. The foam dispenser of claim 1 further comprising a sensor for providing position information to the motor controller.

6. The foam dispenser of claim 1 further comprising a refill unit.

7. The foam dispenser of claim 6 wherein the refill unit comprises a first container, a second container, a first flexible outlet tube, a second flexible outlet tube and a mixing chamber.

8. The foam dispenser of claim 7 further comprising a space between the first outlet tube and the second outlet tube for fitting over the plate.

9. A refill unit for a foam dispensing system, the refill unit comprising:

a first container holding a first liquid;

a first outlet tube extending away from the first container;

a second container holding a second liquid;

a second outlet tube extending away from the second container;

the first liquid and the second liquid chemically react when combined with one another;

a space between the first liquid tube and the second liquid tube for receiving a plate therebetween;

a mixing tube, wherein each of the first outlet tube and the second outlet tube are fluidically connected to the mixing tube, such that a mixing chamber is formed within the mixing tube at a point where the first liquid mixes with the second liquid; and a sealing member to seal the first outlet tube and second outlet tube when the refill unit is not installed in a dispenser;

wherein the first outlet tube and the second outlet tube have a flexible portion which is disposed within a pinching region of the foam dispensing system, such that at least one pinching element of the dispensing system successively engages and disengages the flexible portion of the first outlet tube and the second outlet tube, to thereby cause the first liquid and the second liquid to enter the mixing chamber and form a mixture that expands to become a foam.

10. The refill unit of claim 9, wherein the first liquid comprises a weak acid and the second liquid comprises a weak base.

11. The refill unit of claim 10, wherein at least one of the first and second liquids further comprises a wax.

12. The refill unit of claim 9, further comprising an outlet nozzle disposed at a dispensing end of the mixing tube downstream of the mixing chamber.

13. The refill unit of claim 9, wherein the pinching element successively engages and disengages an outlet tube.

14. The refill unit of claim 9, wherein the mixing tube narrows in a region corresponding to the mixing chamber.

15. The refill unit of claim 9, wherein the mixing tube comprises one or more baffles in a region corresponding to the mixing chamber.

16. The refill unit of claim 9, further comprising a clipping element, wherein the clipping element interacts with a mating element of the system when the refill unit is properly installed in the system.

17. A foam dispensing system comprising:

a first container holding a first liquid;

a first outlet tube extending away from the first container;

a second container holding a second liquid;

a second outlet tube extending away from the second container;

a mixing tube, wherein each of the first outlet tube and the second outlet tube are fluidically connected to the mixing tube, such that a mixing chamber is formed within the mixing tube at a point where the first liquid mixes with the second liquid;

a first dispensing wheel mounted on a shaft defining an axis of rotation for the first dispensing wheel, the first dispensing wheel comprising at least one pinching element disposed on an interior side of the first dispensing wheel which is adjacent to at least one of the first outlet tube, the second outlet tube, and the mixing tube;

a second dispensing wheel mounted on a shaft defining an axis of rotation for the second dispensing wheel, the second dispensing wheel comprising at least one pinching element disposed on an interior side of the second dispensing wheel which is adjacent to at least one of the first outlet tube, the second outlet tube, and the mixing tube an actuator for rotating the first and second dispensing wheels around the axis of rotation such that, as the first and second dispensing wheel rotate, the pinching elements successively engages and disengages at least one of the first outlet tube, the second outlet tube, and the mixing tube, to thereby cause the first liquid and the second liquid to enter the mixing chamber and form a mixture that expands to become a foam.

18. The foam dispensing system of claim 17, further comprising a rigid plate member disposed between the first outlet tube and the second outlet tube, and wherein the pinching element of the first dispensing wheel successively engages and disengages at least the first outlet tube, and the pinching element of the second dispensing wheel successively engages and disengages at least the second outlet tube.

19. The foam dispensing system of claim 17, wherein the pinching elements are selected from the group consisting of a protuberance, a roller, and a spring-loaded projection.

20. The foam dispensing system of claim 17, further comprising a bumper element disposed on the interior side of the first dispensing wheel, wherein the bumper element successively engages and disengages at least one of the first outlet tube, the second outlet tube, and the mixing tube as the first dispensing wheel rotates around the axis of rotation.

* * * * *